US005375103A

United States Patent [19]

Ulloa

[11] Patent Number: 5,375,103

[45] Date of Patent: Dec. 20, 1994

[54] BASKETBALL HOOP ALARM CLOCK

[76] Inventor: Frank Ulloa, 404 Bold Ruler Ave., Edinburg, Tex. 78539

[21] Appl. No.: 205,263

[22] Filed: Mar. 3, 1994

[51] Int. Cl.[5] ..... G04B 23/00

[52] U.S. Cl. ..... 368/12; 368/223; 368/262; 368/265

[58] Field of Search ..... 368/10–12, 368/72, 223, 228, 243, 244, 250, 262–266

[56] References Cited

U.S. PATENT DOCUMENTS

D. 242,990 1/1977 Jorgenson .
D. 307,396 4/1990 Ilaria et al. .
D. 325,875 5/1992 Phillips .
D. 331,369 12/1992 Chen .
4,505,597 3/1985 Flinn, Jr. ..... 368/250
4,702,614 10/1987 Copley et al. ..... 368/72
4,956,828 9/1990 Yamada .

*Primary Examiner*—Bernard Roskoski

[57] ABSTRACT

An electronic wall mountable alarm clock is simulative of a basketball backboard with red lighted numbers displaying the time of day. The backboard has buttons on top for setting the time and the alarm. A rim attached to the backboard has two photocells positioned directly across from each other such that when the alarm sounds at a previously set time, a ball can be tossed through the basket between the photocells shutting the alarm off. Soft rubber balls can be used with the hoop alarm clock. The alarm can also be turned off manually.

10 Claims, 3 Drawing Sheets

BASKETBALL HOOP ALARM CLOCK

BACKGROUND OF THE INVENTION

1. Field of the Invention

The present invention relates generally to alarm clocks, and more particularly, to an alarm clock simulative of a basketball goal.

2. Description of the Prior Art

Clocks of assorted types, including alarm clocks and wall mounted clocks.

SUMMARY OF THE INVENTION

To achieve the foregoing and other advantages, the present invention, briefly described, provides an electronic wall mountable alarm clock simulative of a basketball backboard with red lighted numbers displaying the time of day. The backboard has buttons on top for setting the time and the alarm. A rim attached to the backboard has two photocells positioned directly across from each other such that when the alarm sounds at a previously set time, a ball can be tossed through the basket between the photocells shutting the alarm off. Soft robber balls can be used with the hoop alarm clock. The alarm can also be turned off manually.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new basketball hoop alarm clock which has all of the advantages of the prior art and none of the disadvantages.

It is another object of the present invention to provide a new basketball hoop alarm clock which may be easily and efficiently manufactured and marketed.

It is a further objective of the present invention to provide a new basketball hoop alarm clock which is of durable and reliable construction.

An even further object of the present invention is to provide a new basketball hoop alarm clock which is susceptible of a low cost of manufacture with regard to both materials and labor, and which accordingly is then susceptible of low prices of sale to the consuming public, thereby making such basketball hoop alarm clock available to the buying public.

Still yet a further object of the present invention is to provide: an electronic wall mountable alarm clock simulative of a basketball backboard with lighted numbers displaying the time of day, the backboard having buttons on top for setting the time and the alarm.

It is still a further object of the present invention to provide a new basketball hoop alarm clock with a rim attached to a backboard, the rim having two photocells positioned directly across from each other such that when the wake-up alarm sounds at a previously set time, a soft ball can be tossed through the basket between the photocells shutting the alarm off.

Still a further object of the present invention is to provide a new basketball hoop alarm clock including means for shutting the alarm off manually.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

Figure 1:
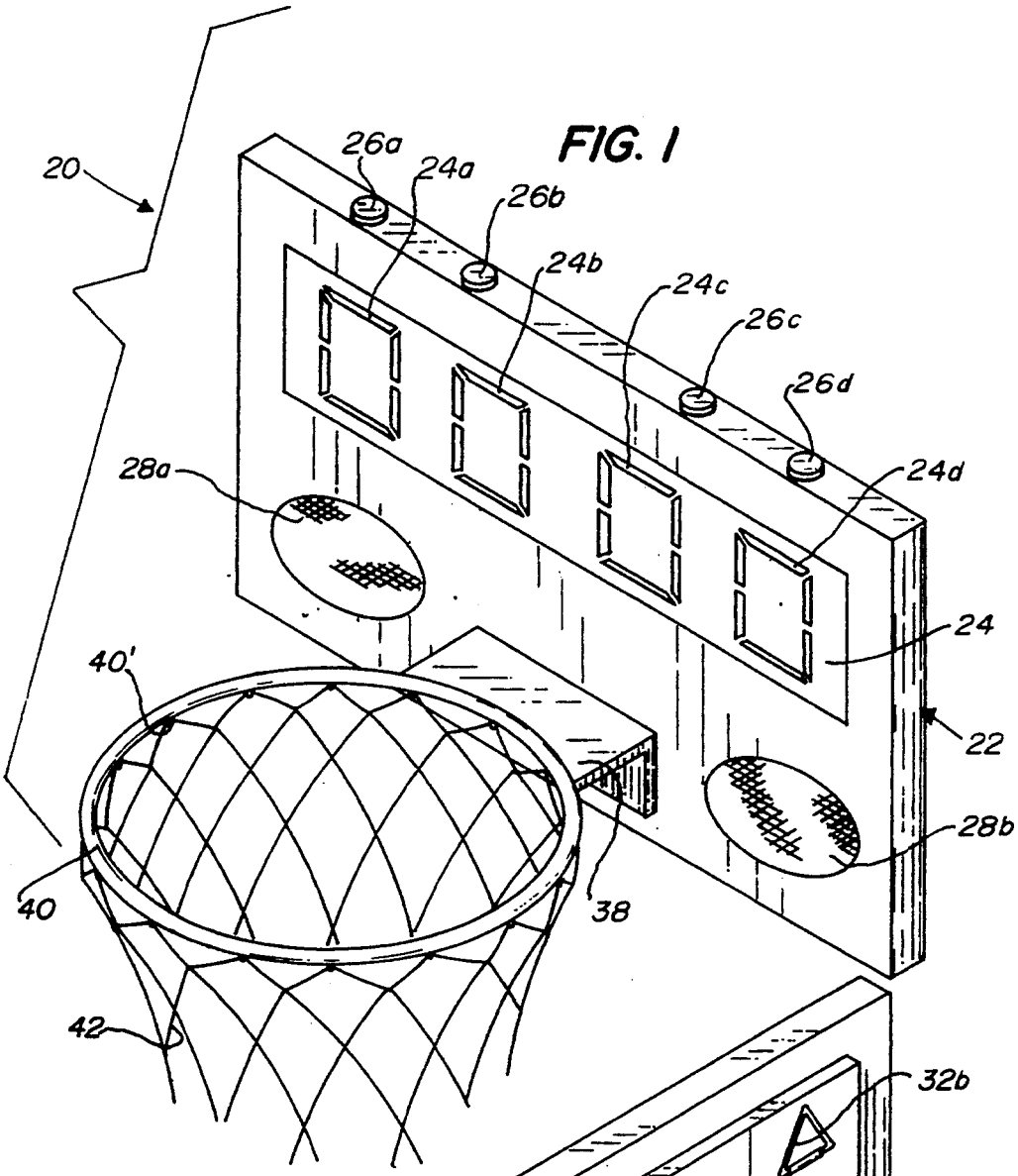
FIG. 1 is a perspective view showing the preferred embodiment of the basketball hoop alarm clock of the present invention.

With reference now to the drawings, a new basketball hoop alarm clock embodying the principles and concepts of the present invention will be described. In this specification, the terms basket and hoop and goal are used essentially synonymously to designate a combination of a basketball type backboard and rim attached thereto.

The present invention is an alarm clock simulative of a basketball hoop (or basket or goal).

Turning initially to FIGS. 1–4, there is shown an exemplary embodiment of the basketball hoop alarm clock of the present invention generally designated by reference numeral 20. In its preferred form, basketball hoop alarm clock 20 comprises generally a backboard 22 having a numerical display 24 and a rim 40 mounted to the backboard 22 by a bracket 38.

The numerical display 24 is simulative of numerical display scoreboards sometimes located on basketball backboards. However, the numerical display 24 in the present invention is a clock and thus displays the time of day rather than a score. The four time display numerals **24*a*, 24*b*, 24*c*, and 24*d*** digitally display the time of day.

The time and the wake-up alarm are set by means of time and alarm setting buttons **26*a*, 26*b*, 26*c*, and 26*d*. The alarm is preferably sounded through a pair of speakers 28*a* and 28*b***.

Figure 2:
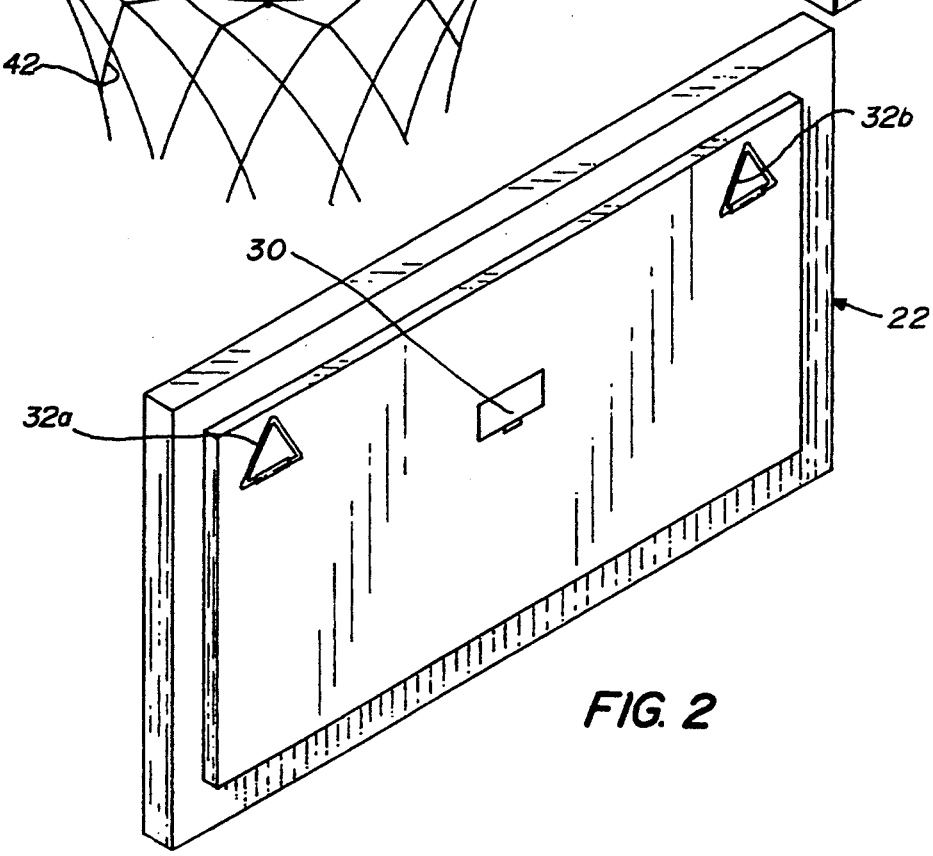
FIG. 2 is a perspective view of the rear of the present invention basketball hoop alarm clock of FIG. 1.
Figure 3:
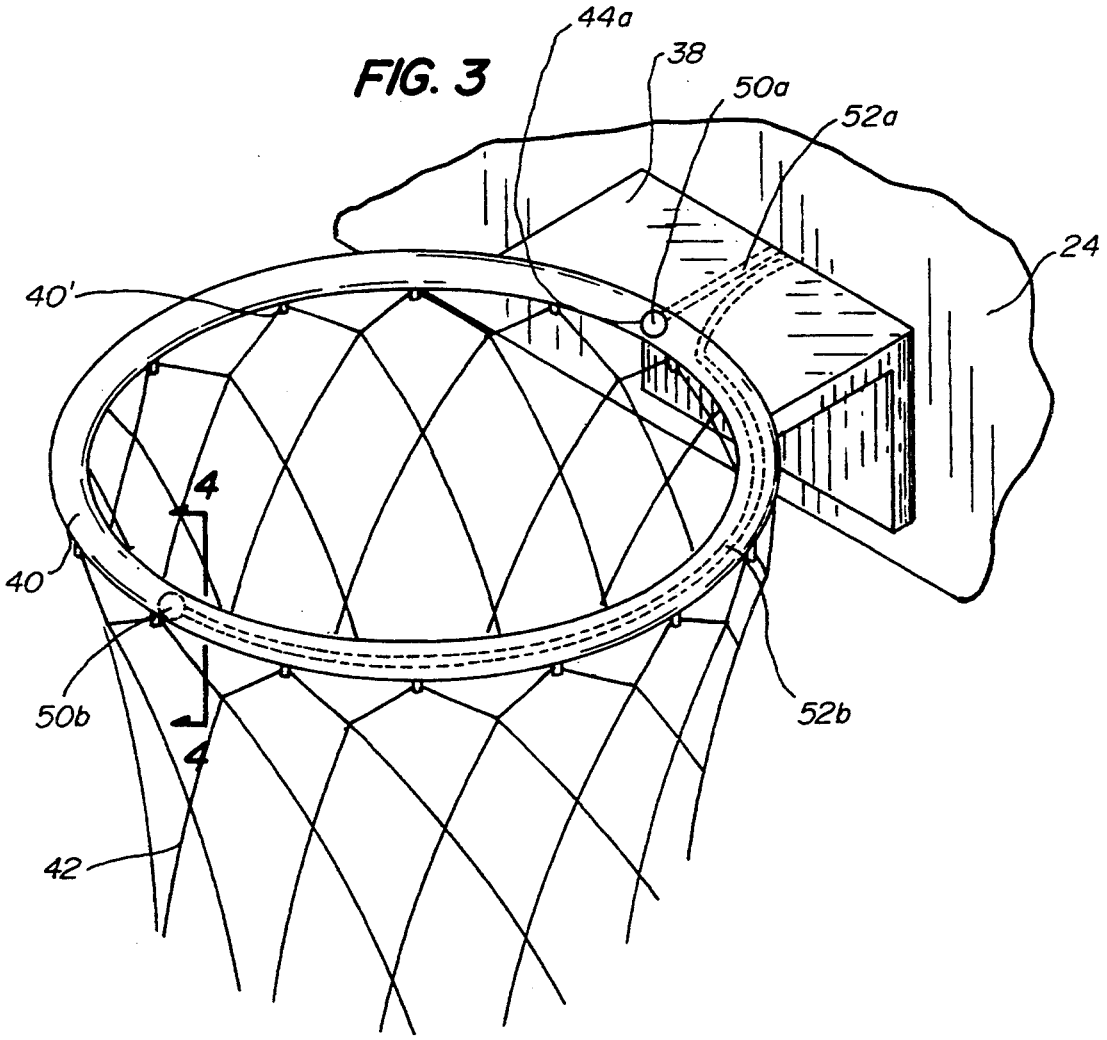
FIG. 3 is a perspective view of a part of the basketball hoop alarm clock of FIGS. 1 and 2 in accordance with the present invention.
Figure 4:
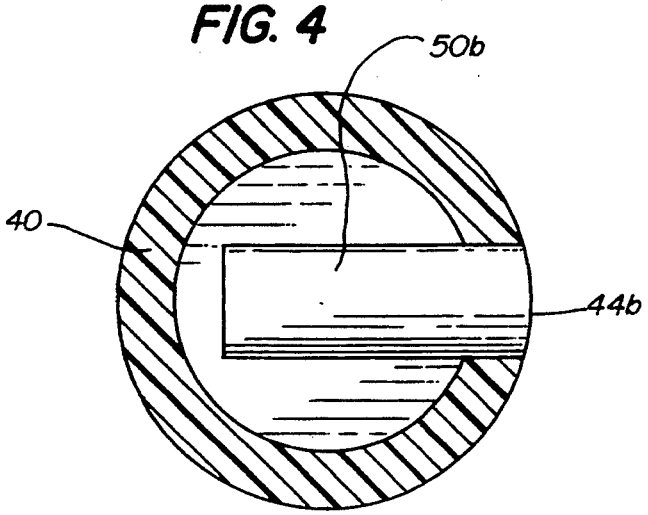
FIG. 4 is a cross-sectional view of the basketball hoop alarm clock of FIG. 3 taken along line 4—4 thereof.

FIG. 2 shows the back side of the backboard 22 which has a battery compartment 30 and preferably a pair of hooks **32*a* and 32*b* for hanging the backboard 22** on a wall.

The bracket 38 for holding the rim 40 (see particularly FIG. 3) to the backboard 20 is preferably integrally formed with the rim 40. A net 42 can be hung from the rim 40 preferably through the use of eyeholes or hooks 40' on 40.

Figure 6:
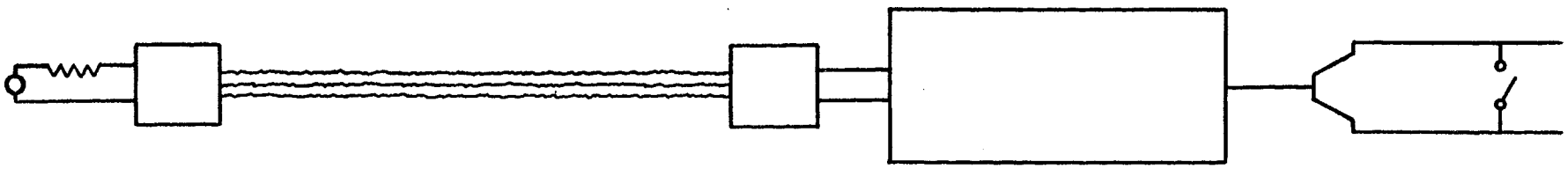
FIG. 6 is a circuit diagram for a circuit system which can be utilized as part of the present invention.

The rim 40 is hollow and has a pair of oppositely positioned holes **44*a* and 44*b*. A pair of oppositely positioned sensors 50*a* and 50*b* are held within the holes 44*a* and 44*b* respectively. Electrical wires 52*a* and 52*b* run from the battery source to power the sensors 50*a* and 50*b* respectively. The system is constructed such that when the alarm is sounded, an object (preferably a soft ball simulative of a basketball) passing between the two sensors 50*a* and 50*b* blocking their communication with each other which shuts off the alarm. An electrical circuit diagram which can be utilized for the system is shown in FIG. 6**.

Figure 5:
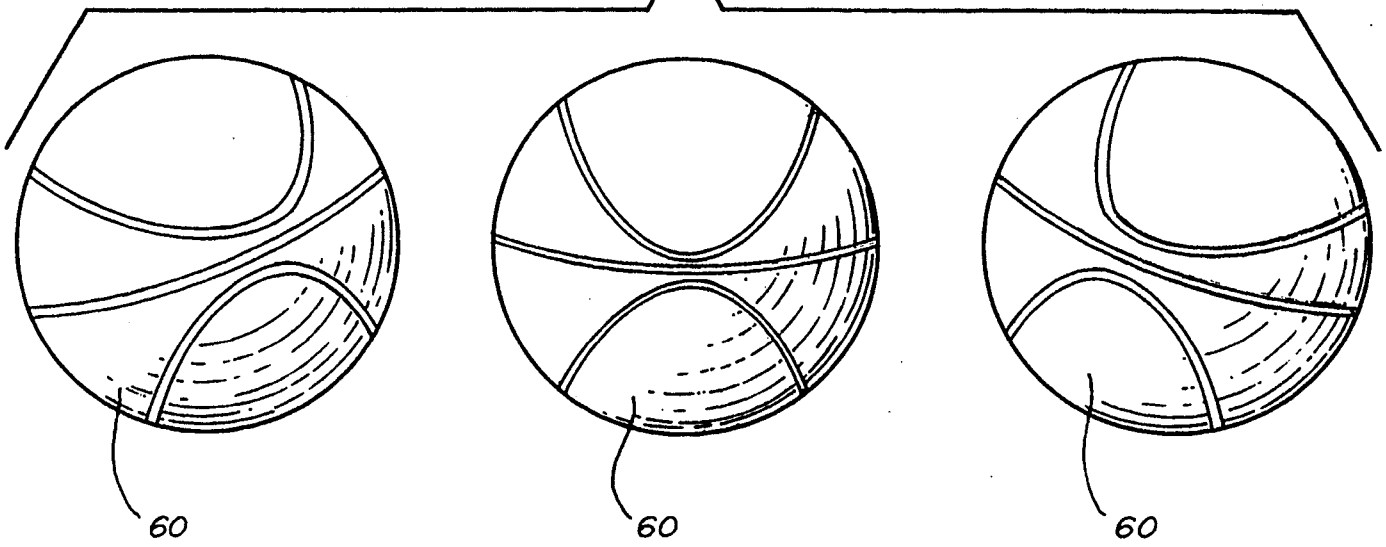
FIG. 5 is a view of a set of balls which can be used as part of the present invention.

FIG. 5 shows three similar balls 60 which can be used with the alarm clock hoop of the present invention. The balls are preferably made out of a suitable soft material (such as and preferably rubber) to prevent accidents since the balls will be used indoors.

Use of the present invention is very easy. A pair of nails (or other hanging means) are hammered into a wall at the same spacing as the hooks **32*a* and 32*b* in the back of backboard 22. Fresh batteries (if needed) are placed in the battery compartment 30. The goal 20 is hung on the nails on the wall by means of hooks 32*a*. The time and alarm are set using buttons 26*a*, 26*b*, 26*c* and 26*d*. When the alarm goes off waking a sleeping person, the person is forced to become active by trying to toss the balls 60 through the rim 40 of the hoop 20. If the person misses with all of the balls, he or she can get up and manually turn off the alarm. By forcing the person to become active, the hoop dock 20** of the present invention makes waking up easier (and more fun).

While the above describes the preferred embodiment of the present invention, it should be noted that changes and additions could be made while keeping the primary spirit of the invention and such differences should be considered within the scope of the invention. For example, the hoop alarm clock of the present invention could be powered by AC rather than the preferred DC. Also, a recorded cheering sound could be made to emanate from the speakers when a basket is made. Also, the device could have a secondary mode in which the clock displayed could be switched to a score display which could record the number of baskets made in a specified amount of time. For example, the left two numerals **24*a* and 24*b* could be a countdown timer, while the right two numerals 24*c* and 24*d*** could count the number of baskets (or points) made.

It is apparent from the above that the present invention accomplishes all of the objectives set forth by providing a new device comprising: an alarm clock simulative of a basketball goal. The alarm clock can be comprised of: a backboard having a digital numerical display for displaying the time of day and alternately the time set for the alarm; and a rim mounted on the backboard, the rim having a means for detecting when an ball or other object goes through the rim, the means for detecting being able to signal the turning off of the alarm when the ball or other object goes through the rim. The means for detecting when an object goes through said rim can be a pair of photocells located across from each other and in communication with each other. The device can be powered by batteries which can be positioned within the device or by AC power. The device can have means for hanging on the wall. The device can be powered by AC power. The device can have a second mode of operation for the playing of a game with means :for keeping track of the number of baskets made in a specified amount of time. The invention can also have a means for playing a recording of cheer when a basket is made.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by LETTERS PATENT of the United States is as follows:

1. A new device comprising:

an alarm clock simulative of a basketball goal; and a backboard having a digital numerical display for displaying the time of day and alternately the time set for the alarm; and a rim mounted on said backboard, said rim having a means for detecting when an ball or other object goes through said rim, said means for detecting being able to signal the turning off of the alarm when the ball or other object goes through the rim.

2. The invention of claim 1 wherein said means for detecting when an object goes through said rim is a pair of photocells located across from each other and in communication with each other.

3. The invention of claim 2 wherein said device is powered by batteries which can be positioned within the device.

4. The invention of claim 2 wherein said device has means for hanging on the wall.

5. The invention of claim 2 wherein said device can be powered by AC power.

6. The invention of claim 2 wherein said device has a second mode of operation for the playing of a game with means for keeping track of the number of baskets made in a specified amount of time.

7. The invention of claim 2 further comprising a means for playing a recording of cheer when a basket is made.

8. A alarm clock device comprising:

an alarm clock simulative of a basketball goal, said alarm clock having:

a backboard having a digital numerical display for displaying the time of day and alternately the time set for the alarm;

a rim mounted on said backboard, said rim having a means for detecting when an ball or other object goes through said rim, said means for detecting being able to signal the turning off of the alarm when the ball or other object goes through the rim, said means for detecting when an object goes through said rim is a pair of photocells located across from each other and in communication with each other;

wherein said device is powered by batteries which can be positioned within the device; and wherein said device has means for hanging on the wall.

9. The invention of claim 8 wherein said device has a second mode of operation for the playing of a game with means for keeping track of the number of baskets made in a specified amount of time.

10. The invention of claim 9 further comprising a means for playing a recording of cheer when a basket is made.

* * * * *